US006390661B1

(12) United States Patent
Bellasalma et al.

(10) Patent No.: US 6,390,661 B1
(45) Date of Patent: May 21, 2002

(54) RAPID DISCHARGE MULTIPLE MATERIAL DELIVERY SYSTEM

(75) Inventors: Gerard Jay Bellasalma, Yorba Linda; Joon Taek Kim, West Hollywood, both of CA (US)

(73) Assignee: Masco Corporation, Taylor, MI (US)

( * ) Notice: Subject to any disclaimer, the term of this patent is extended or adjusted under 35 U.S.C. 154(b) by 0 days.

(21) Appl. No.: 09/662,302

(22) Filed: Sep. 15, 2000

(51) Int. Cl.[7] ..... B01F 15/04; B67D 5/46

(52) U.S. Cl. ..... 366/162.3; 366/173.1; 222/137

(58) Field of Search ..... 366/162.4, 162.1, 366/162.3, 173.1, 182.2, 76.1, 76.6, 76.7; 222/137, 134, 135, 136, 309

(56) References Cited

U.S. PATENT DOCUMENTS 3,049,757 A 8/1962 Hagerborg
3,516,123 A 6/1970 Lang et al.
3,837,534 A * 9/1974 Natelson
3,963,148 A * 6/1976 Proni et al.
4,118,799 A * 10/1978 Krueger
4,285,903 A 8/1981 Lemelson
4,459,029 A * 7/1984 Veyriere
5,022,847 A 6/1991 Hehl
5,114,241 A * 5/1992 Morrison
5,234,268 A * 8/1993 Homan
5,350,233 A * 9/1994 Sonntag et al.
5,524,983 A * 6/1996 Dittgen et al.
5,875,928 A 3/1999 Muller et al.
6,168,308 B1 * 1/2001 Pittman et al.

* cited by examiner

*Primary Examiner*—Tony G. Soohoo
(74) *Attorney, Agent, or Firm*—Carlson Gaskey & Olds

(57) ABSTRACT

A rapid discharge multiple material delivery molding system includes a feed assembly having an upper portion, a movable middle portion and a lower portion. A drive is mounted between the middle portion and the lower portion to drive the middle portion and simultaneously control the intake and discharge of a fluid material from each of a plurality of fluid delivery containers. Each fluid delivery container is specifically sized to contain a predetermined volume of fluid material. By attaching a plurality of variously sized fluid delivery containers to the lower portion, an exact volume of each fluid material is dispensed simultaneously upon a downward stroke of the middle portion.

23 Claims, 4 Drawing Sheets

RAPID DISCHARGE MULTIPLE MATERIAL DELIVERY SYSTEM

BACKGROUND OF THE INVENTION

The present invention relates to a molding machine, and more particularly to a feed assembly for a molding machine that simultaneously provides a repeatable predetermined volume of each of a multiple of fluid material components.

Many molding machines provide for the mixing of at least two fluid materials to form a hardenable or settable mixture which can be discharged into a mold cavity in the formation of an article molded of synthetic resin. The fluid materials commonly include at least two reactive components, e.g. isocyanates and polyols in the molding of polyurethanes or epoxide resins and amine hardeners in the molding of epoxies. Other settable mixtures can include three components such as a catalyst, a matrix polymer and a foaming agent.

A multiple of the fluid materials are typically fed from a supply by a delivery or feed assembly which communicates with a mixing head. Each fluid material is mixed by the mixing head and discharged into the mold cavity to form the molded article.

SUMMARY OF THE INVENTION

An important aspect of the molding process is the quantity of each fluid material that is supplied to the mixing head during each cycle of the molding machine. Each fluid material must be simultaneously feed in the correct quantity to the mix head to assure the correct composition of the finished material. Each fluid material must also be repetitively supplied in correct metered quantities during each cycle of the molding machine to maintain the consistency of each molded article. It is further desired to supply the metered quantities over the shortest period of time to improve productivity of the molding process.

The rapid discharge multiple material delivery molding system according to the present invention generally includes a feed assembly having an upper portion, a movable middle portion and a lower portion. A drive is mounted between the middle portion and the lower portion to drive the middle portion along guide posts to simultaneously control the intake and discharge of a fluid material from each of a plurality of fluid delivery container.

Each fluid delivery container generally includes a fluid cylinder attached between a packing assembly, a lower mounting assembly and a port assembly which includes an inlet port and an outlet port. Although a cylinder is illustrated in the disclosed embodiment, it should be realized that other container shapes will benefit from the present invention. Importantly, the fluid cylinder is specifically sized to contain a predetermined volume of fluid material. By attaching a plurality of variously sized fluid delivery containers to the lower portion, an exact volume of each fluid material is dispensed simultaneously upon a downward stroke of the middle portion.

Each inlet port communicates with a fluid material supply while each outlet port communicates with a mix head. Valves located in each fluid port control the flow of the fluid material in response to movement of the middle portion. Each valve can be connected to a controller and preferably operated pneumatically.

As the drive strokes the middle portion, the valve in each inlet port is opened while the valve in each outlet port is closed. Accordingly, when the middle portion reaches the top of its stroke, each fluid cylinder is filled. Because the fluid cylinder has been previously sized to contain only a measured quantity of fluid material, the system is assured of providing the correct ratio of each fluid material during each cycle. The drive is then reversed to drive a piston rod into each fluid cylinder. The fluid material in each fluid delivery container is now discharged to the mix head where the correct predetermined volume (due to the sized fluid cylinders) reaches the mix head simultaneously (due to each piston rod being linked to the middle portion). A correct mix of fluid material is thereby assured to reach the mix head. In other words, the flow of each component per unit time maintains the correct ratio. An effective final material and thus a consistent molded article is assured.

In one embodiment a pump is located along each conduit between each fluid material supply and the feed assembly. The pumps assist in filling each fluid cylinder during the upward stroke of the middle portion.

In another embodiment, at least some of the material supplies are individually pressurized to assist in filling each fluid cylinder while avoiding the use of pumps. Pressurizing each fluid material supply is particularly desirable when a delicate fluid material is being dispensed. It is further preferred that all the conduits which supply the fluid material are only gently curved and ninety degree bends are particularly avoided. These two aspects are particularly beneficial with the polymer matrix being moved to the mix head which is an inventive material as also invented by applicant wherein the matrix carries glass fibers. Preferably, the glass fibers are enclosed in a protective coating (silicone and/or epoxy). The coating prevents the fiber from beginning to react. In the mix head, the coatings are smashed and the fibers can begin to react. However, the pressure supply and curved conduits avoid the coatings from being smashed until it reaches the mix head.

The present invention therefore provides a molding machine that simultaneously provides a repeatable predetermined volume of each of a multiple of fluid material components.

The disclosed system is particularly valuable when used to move the several components for molding large items to a mix head and then a mold. In one application the mold is forming large tub and shower surrounds.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
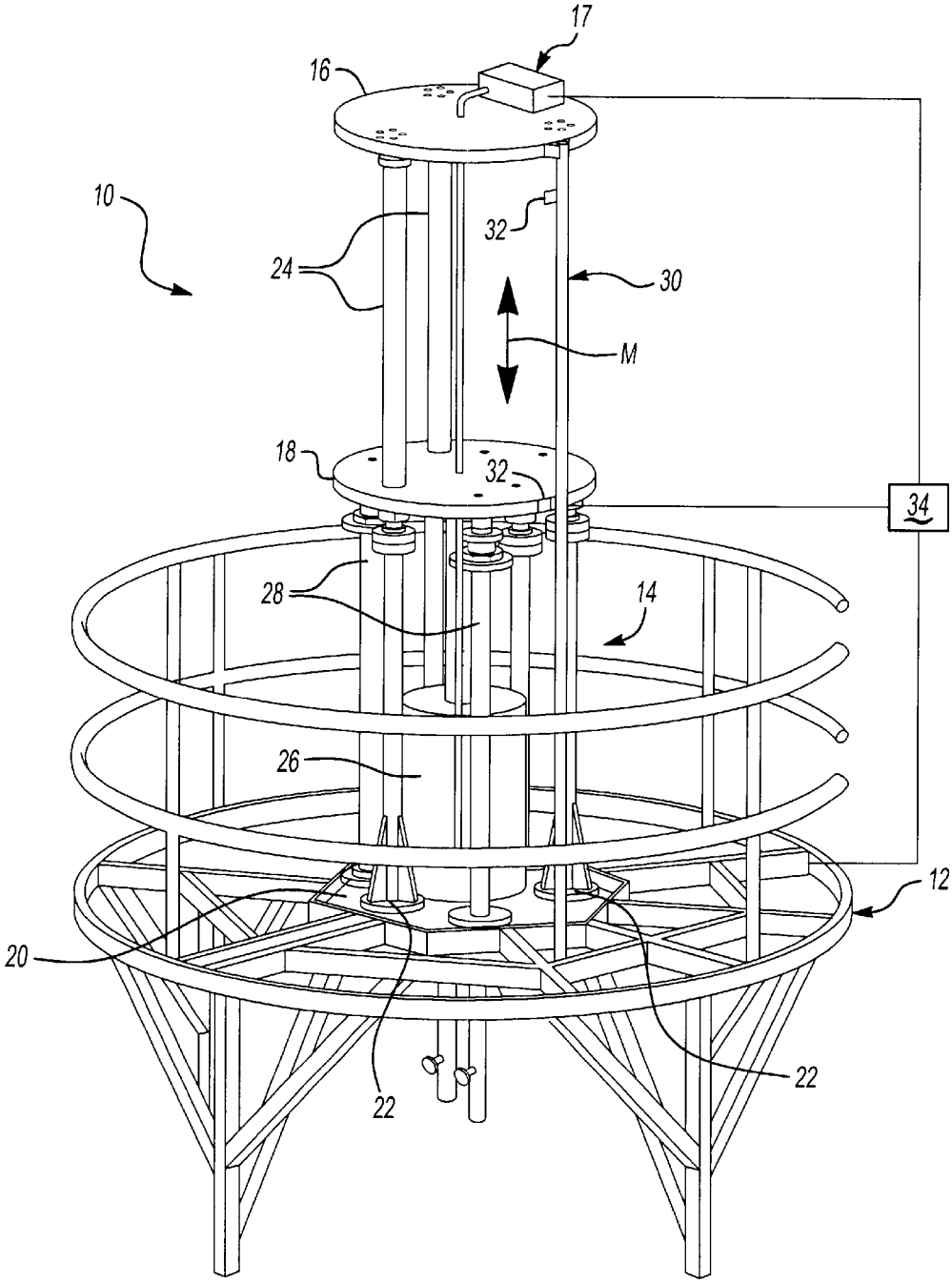
FIG. 1 is a general perspective view of rapid discharge multiple material delivery molding system according to the present invention.

FIG. 1 illustrates a rapid discharge multiple material delivery molding system 10. The system 10 generally includes a platform 12 and a feed assembly 14. The feed assembly 14 includes an upper portion 16, a middle portion 18 and a lower portion 20. A plurality of guide columns 22 are mounted to the lower portion 20. Each guide column 22 supports a guide post 24 which supports the upper portion 16.

A drive 26 such as a hydraulic, pneumatic, or mechanical powered system is preferably mounted between the middle portion 18 and lower portion 20 to drive the middle portion 18 along the guide posts 24 in the direction of arrow M. As will be further described below, the middle portion 18 is attached to a plurality of fluid delivery containers 28 to simultaneously control the intake and discharge of a fluid material from each fluid delivery container 28.

A sensor post 30 extends from the lower portion 20 to the upper portion 16. A plurality of sensors 32 are attached to the sensor post 30 to identify the location of the middle portion 18 along the guide posts 24 and control the stroke distance thereof. A controller (shown schematically at 34) communicates with, a rotary encoder 17, the drive 26, and the sensors 32. The encoder 17 identifies the position of the middle portion 18 and communicates with the controller 34 to assure the system 10 is operating within predefined parameters. Preferably, the controller 34 injects a predetermined shot-size into a tool (not shown) for large parts, and in particular, bath tubs and shower surrounds.

Figure 1A:
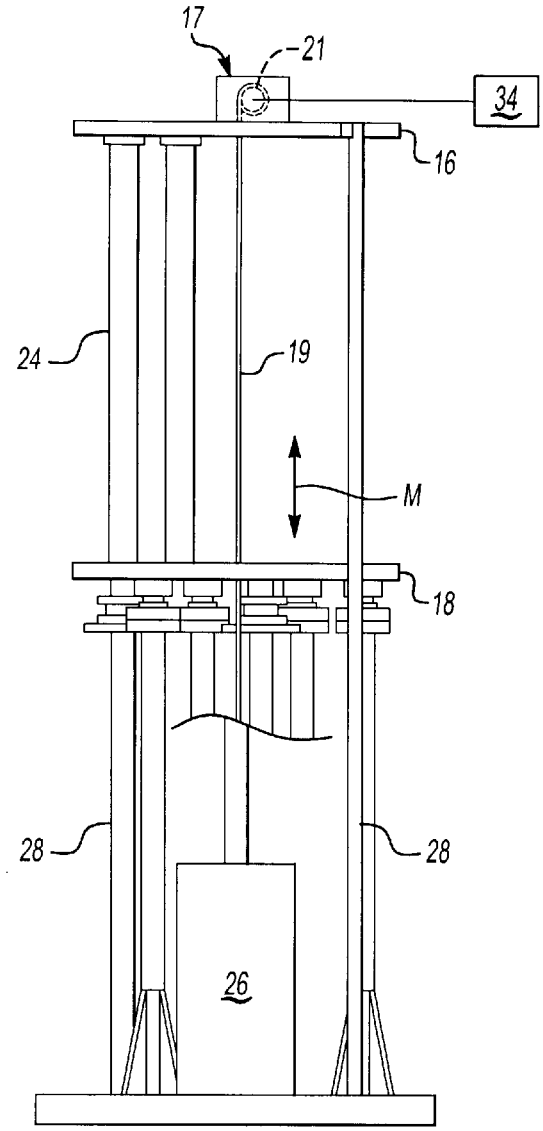
FIG. 1A is an exploded schematic view of the rotary encoder and middle portion illustrated in FIG. 1.

The controller 34 further communicates with the encoder 17 to control the speed of the drive 26 in response to pressure feed-back from within the tool. The greater the pressure within the tool, the slower the controller 34 operates the drive 26. The drive 26 may therefore be varied during each injection sequence to accurately control the discharge of a fluid material from each fluid delivery container 28. Preferably, the encoder 17 is connected to the middle portion 18 by a tensioned cable 19 or the like through a rotatable sheave 21 in the encoder 17 (FIG. 1A). As the middle portion 18 is driven by the drive 26, the cable 19 rotates the sheave 21. The controller 34 will thereby convert the rotary motion of the sheave 21 to determine the linear motion of the middle portion 18 preferably through software in the controller 34. Accordingly, a precise measurement of the middle portion 18 positional movement to accurately control the intake and discharge of a fluid material from each fluid delivery container 28.

Figure 2:
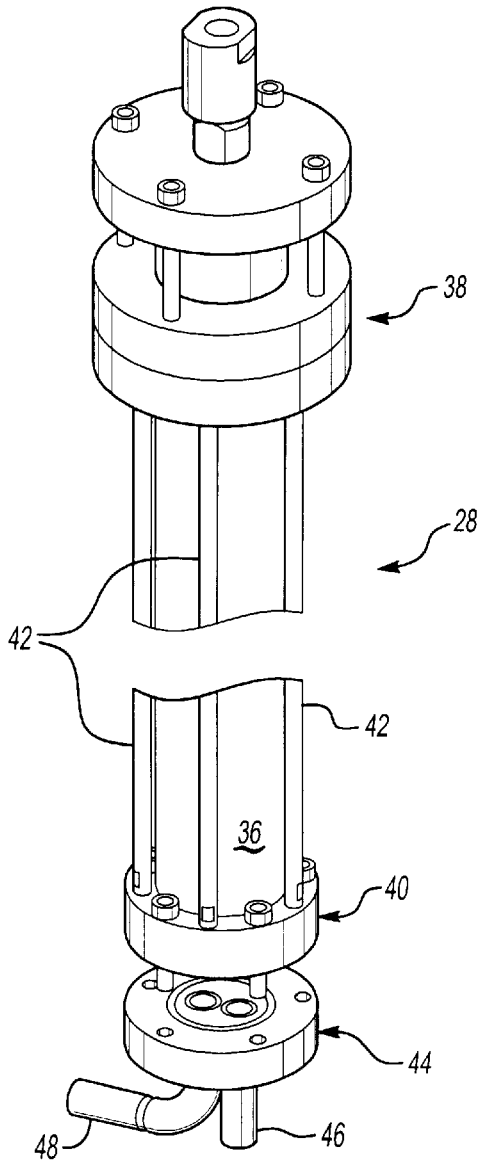
FIG. 2 is an exploded view of a fluid delivery container.

Referring to FIG. 2, a perspective view of one fluid delivery containers 28 is illustrated. The fluid delivery container 28 generally includes a fluid cylinder 36 attached between a packing assembly 38, a lower mounting assembly 40 and a fluid port assembly 44 which includes an inbound fluid port 46 and an outboard fluid port 48. A plurality of tie rods 42 preferably link the packing assembly 38 and the lower mounting assembly 40 to support the fluid cylinder 36. Although a cylinder is illustrated in the disclosed embodiment, it should be realized that other container shapes will benefit from the present invention.

Figure 3:
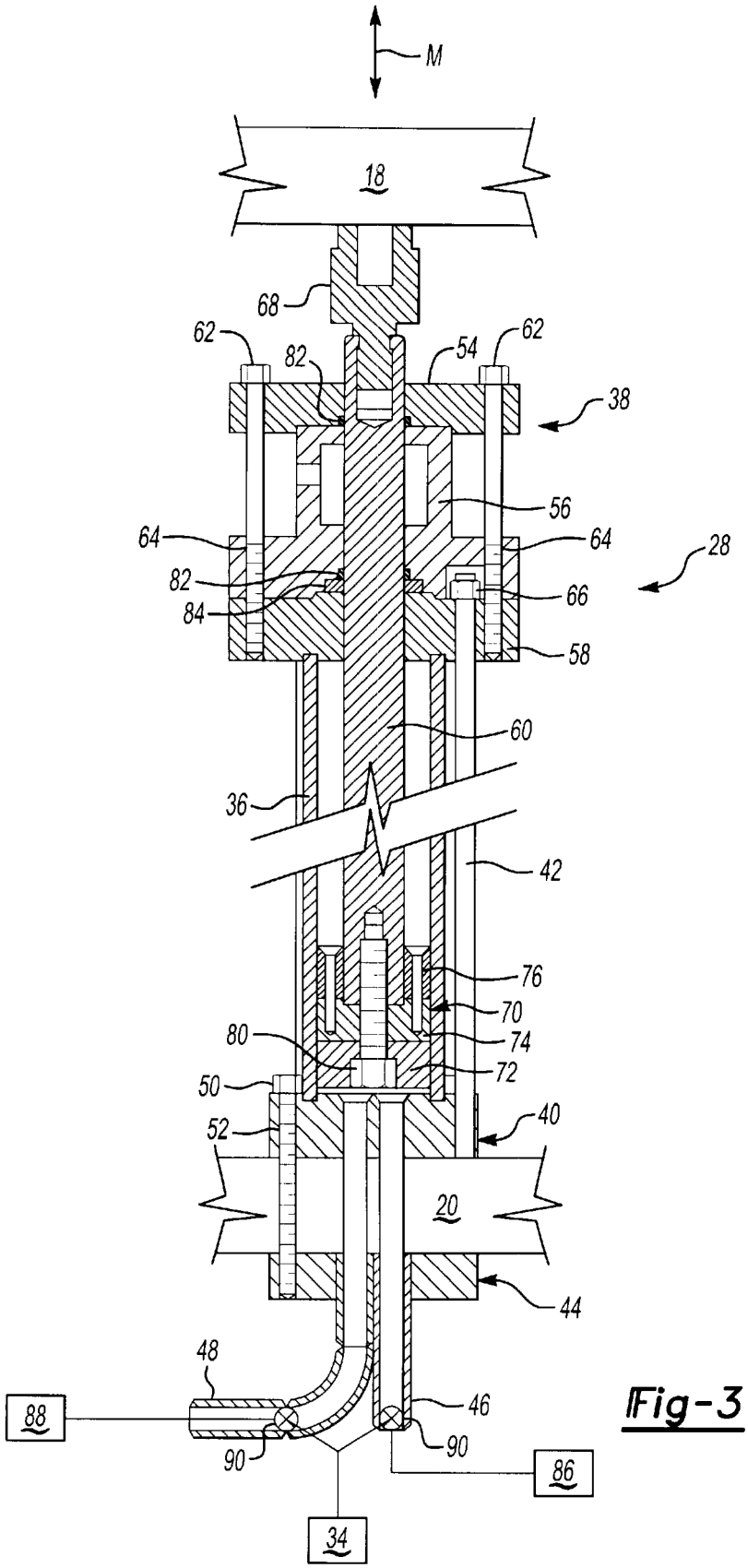
FIG. 3 is a sectional view of the fluid delivery container illustrated in FIG. 2.

Referring to FIG. 3, a sectional view of the fluid delivery containers 28 is illustrated. The lower mounting assembly 40 removably mounts the fluid delivery container 28 to the lower portion 20 by a plurality of fasteners 50. By providing a standardized lower mounting assembly 40 which correspond to threaded apertures 52 within the lower portion 20, variously sized fluid delivery containers 28 can be interchangeably attached to the lower portion 20. Importantly, the fluid cylinder 36 is specifically sized to contain a predetermined volume of fluid material such as a reactive synthetic resin component. As will be further described below, by attaching a plurality of variously sized fluid delivery containers 28 to the lower portion 20, an exact volume of each fluid material is dispensed simultaneously upon a downward stroke of the middle portion 18.

The packing assembly 38 provides a passage for the piston rod 60. The packing assembly 38 generally includes a flange top 54, a packing housing 56 and a flange bottom 58 which engages the fluid cylinder 36. The packing assembly 38 is preferably formed of separate components for maintenance and adjustment. A plurality of fasteners 62 extend through threaded apertures 64 within the flange top 54, packing housing 56 and flange bottom 58 to cap one end of the fluid cylinder 36. The tie rods 42 preferably engage the flange bottom 58 with a hex nut 66 at one end an threadably engage the lower mounting assembly 40 at the other. The tension created by the tie rods 42 assure that the fluid cylinder 36 is securely capped.

A coupler 68 extends from the piston rod 60 to connect the fluid delivery container 28 with the middle portion 18. The piston rod 60 is attached to a head assembly 70 which is fitted to the inner diameter of the fluid cylinder 36. Preferably, the head assembly 70 and the inner diameter of the fluid cylinder 36 are chrome plated to minimize friction and provide a close fit therebetween. The fluid head assembly 70 generally includes a piston seal 72 a piston head 74, and a wear plate 76. Threaded fasteners 80, or the like retain the head assembly to the piston rod 60. The piston rod 60 extends into the fluid cylinder 36 and the head assembly 70 drives a fluid into and out of the fluid cylinder 36 in response to the motion of the middle portion 20.

A seal 82 is located between the flange top 54 and the packing housing 56. Another seal 82 is located between the flange bottom 58 and the packing housing 56. Seals 82 assist in preventing leakage from within the fluid cylinder 36 along the piston rod 60. Preferably the seals 82 are a Teflon seal. A wiper 84 may also be located between the packing housing 56 and the flange bottom 58 to assist in sealing the piston rod 60 during movement therethrough.

The fluid port assembly 44 is attached to the lower portion 20 opposite the lower mounting assembly 40. The fluid port assembly 44 provides communication of the fluid material into and out of the fluid cylinder 36. Fasteners 50 extend from the lower mounting assembly 40, through the lower portion 60 and into the fluid port assembly 44. It is further preferred that the inlet port 46 and the outlet port 48 which supply the fluid material are gently curved and ninety degree bends are particularly avoided. In other words "J"-shaped bends are preferred over "L"-shaped bends.

The inlet port 46 communicates with a fluid material supply (shown schematically at 86) while the outlet port 48 communicates with a mix head (shown schematically at 88). Valves 90, are preferably located in each fluid port 46, 48 to control the flow of the fluid material in response to movement of the middle portion 18 and attached piston rod 60. Each valve 90 can be connected to the controller 34 and operated, for example, pneumatically, electrically, mechanically or electromechanicaly. Each valve 90 preferably is manufactured of a durable material such as PEEK to resist the repetitive passage of the fluid material. In another embodiment, each valve 90 can be provided as a one-way check valve which responds to movement of the fluid material. Preferably, the vales 90 operate in a cyclic manner, in that when the valve 90 within each inlet port 46 is closed the valve 90 when the outlet ports 48 are open, and vice versa.

In operation, the middle portion 18 is attached to the piston rods 60 extending from the plurality of fluid delivery containers 28 (FIG. 1). Each fluid cylinder 36 is previously sized to contain a predetermined volume of fluid material based upon the desired ratio of fluid materials which must be mixed to create a desired final material at the mix head 88. For example only, a desired final material having a 2:1:1 mix would require three (3) fluid delivery containers 28 of which two would be of equal volume and the third would be twice the volume. Also, in practice several containers can be used for a single material. As one example, the high volume polymer matrix is delivered by three containers, while the catalyst and forming agents are supplied by a single container.

Each fluid delivery containers 28 is connected to a particular fluid material supply 86 and the common mix head 88 through the respective inlet port 46 and outlet port 48. As the middle portion 18 is attached to each piston rod 60 in each fluid delivery container 28, stroking the middle portion 18 away from the fluid delivery containers 28 causes the piston rods 60 to move upward in the fluid cylinder 38. The particular material moves from the fluid material supply 86 into the fluid cylinder 38. As the drive 26 strokes the middle portion 18 upwardly, the valve 90 in each inlet port 46 is open while the valve in each outlet port 48 is closed. Accordingly, when the middle portion 18 reaches the top of its stroke, each fluid cylinder 38 is filled. Because the fluid cylinder 38 has been previously sized to contain only a measured quantity of fluid material, the system 10 is assured of providing the correct ratio of each fluid material during each cycle. The system 10 is now ready to discharge the material.

The drive 26 is reversed to drive each piston rod 60 into each fluid cylinder 38. During this condition, the valve 90 in each inlet port 46 is closed while the valve in each outlet port 48 is open. The fluid material in each fluid delivery container 28 is now discharged to the mix head 88 where the correct predetermined volume (due to the sized fluid cylinders 38) reaches the mix head 88 at about the same time (due to each piston rod 60 being linked to the middle portion 18). A correct mix of fluid material is thereby assured to reach the mix head 88. In other words, the flow of each component per stroke maintains the correct ratio. An optimally mixed final fluid material containing the proper ratio of each fluid component and thus consistent molded article is thereby assured.

Figure 4:
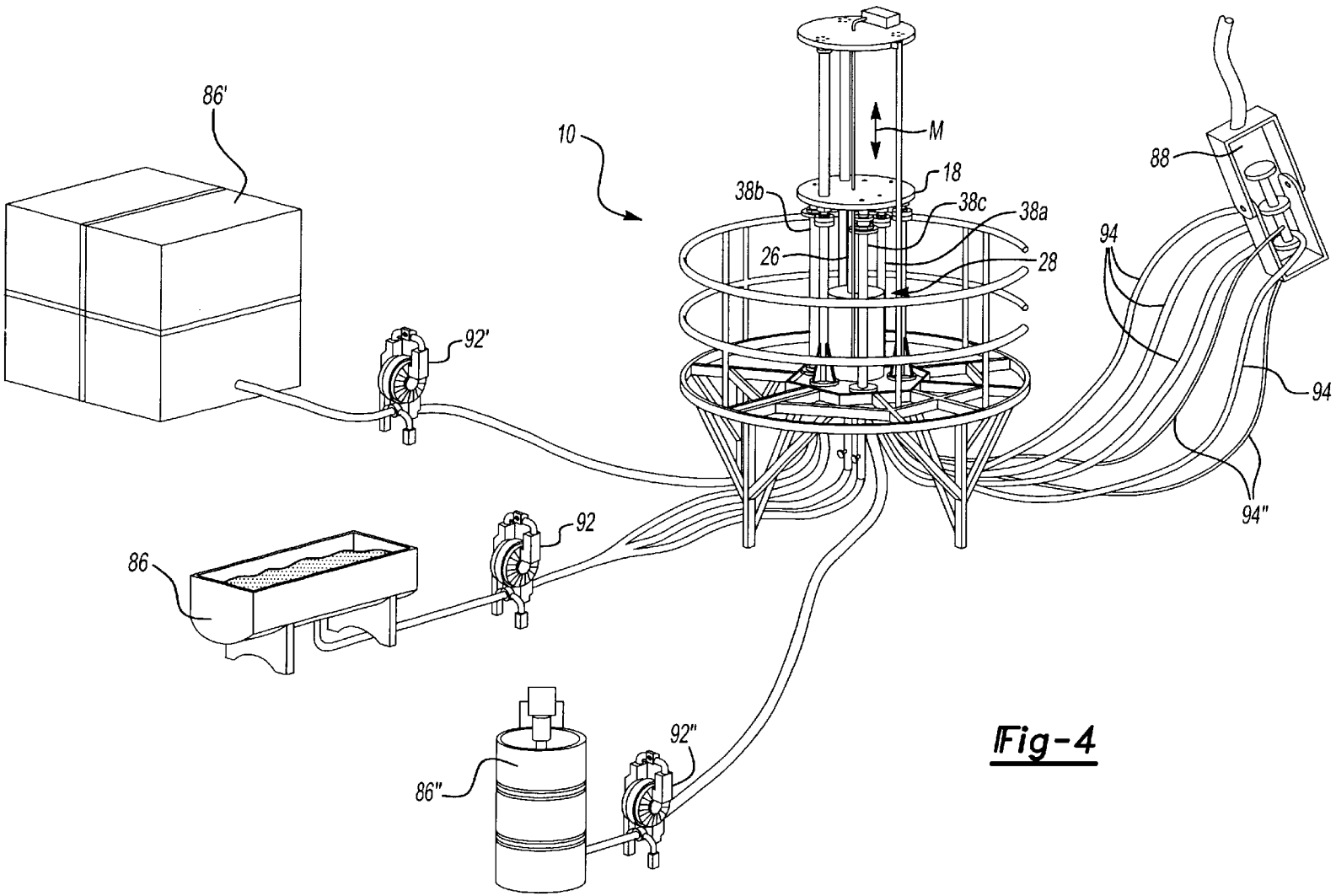
FIG. 4 is a simplified schematic illustration of rapid discharge multiple material delivery molding system including three fluid delivery containers.

Referring to FIG. 4, the system 10 is illustrated schematically. A plurality of fluid delivery containers 28 having variously sized fluid cylinders 38A, 38B, and 38C are attached to a lower portion 20. The middle portion 18 is attached to the fluid delivery containers 28 which moves in the direction of arrow M by drive 26. Each fluid cylinder A, B, and C is connected to a particular fluid material supply 86, 86' and 86" which contains a bulk supply of each fluid component. Each fluid cylinder A, B, and C is also connected to a common mix head 88. Notably, each fluid cylinder 38A–C is sized to provide a predetermined ratio of each fluid material 38A–C to the common mix head 88. Each fluid container 38A, 38B, and 38C is sized to contain one of the three components such as a matrix polymer, BPO catalyst and a foaming agent which form the final settable fluid material mixture. In practice a multiple of fluid containers may be provided with the same fluid material such that the ratio is also controlled not only by the size of the fluid cylinders 38 but also by the number of such fluid cylinders. Further, by providing a multiple of fluid containers with the same fluid material, several ports in the mix head 88 may input the same material, such that the material is injected at circumferentially spaced locations.

In FIG. 4, fluid cylinder 38A is sized to contain one part of the desired final settable fluid material, fluid cylinder 3 8B is four times the size of fluid cylinder 3 8A, and fluid cylinder 38C is four times the size of fluid cylinder 38A. In this example the ratio of A:B:C provided to the mix head 88 during each cycle of the system 10 would be 1:4:4.

A pump 92, 92' and 92" is preferably located along each conduit 94, 94', and 94" between each fluid material supply 86, 86' and 86 and the feed assembly 14. The pumps 94, 94', and 94" assist in filling each fluid cylinder 38A–C during the upward stroke of the middle portion 18. Preferably, the pump 92 which drives the fluid material supply 86 which supplies a coated fiber material operates at a pressure below 50 PSI to assure that the coating is not inadvertently broken prior to reaching mix head 88.

In another embodiment, the fluid material supplies 86, 86' and 86" are individually pressurized to assist in filling each fluid cylinder 38 while avoiding the use of pumps. As mentioned above, this is particularly desirable when delicate coated fibers are being dispensed. Thus, the coating is not broken until reaching mix head 88. Mix head 88 preferably assures that the coating is adequately cracked.

The glass fibers in the matrix greatly increase in viscosity if the coating is cracked prior to reaching the mix head 88. It is further preferred that the conduits 94, 94', and 94" which supply the fluid material are gently curved and ninety degree bends are particularly avoided. In other words generally "J"-shaped bends are preferred over "L"-shaped bends. By providing a smoothed lined, gently curved conduits 94, 94', and 94", turbulence is minimized and the likelihood of inadvertent cracking of the coating is minimized.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A feed system for a molding machine comprising:

a first fluid delivery container;

a second fluid delivery container;

a first inlet port communicating with said first fluid delivery container to receive a first fluid material into said first fluid delivery container;

a second inlet port communicating with said second fluid delivery container to receive a second fluid material into said second fluid delivery container;

a first outlet port communicating with said second fluid delivery container to discharge is the first fluid material from said first fluid delivery container, said first outlet port in communication with said first fluid delivery container independent of said first inlet port;

a second outlet port communicating with said second fluid delivery container to discharge the second fluid material from said second fluid delivery container, said second outlet port in communication with said second fluid delivery container independent of said second inlet port;

a movable portion attached to said first and said second fluid delivery containers;

a drive to drive said movable portion, said moveable portion intaking the first fluid material into said first fluid delivery container and the second fluid material into said second fluid delivery container in response to said drive driving said moveable position in a first direction and to discharge the fist fluid material from said first fluid delivery container and the second fluid material from said second fluid delivery container in response to said drive driving said moveable portion in an opposite direction; and the volumes of said first and second fluid delivery containers being selected relative to each other to result in desired relative volumes of said first and second fluid material being moved by the feed system.

2. The system as recited in claim 1, wherein said first fluid delivery container includes a first piston to intake and discharge the first fluid material, and said second fluid delivery container includes a second piston to intake and discharge the second fluid material into said second fluid delivery container, said first piston and said second piston simultaneously driven by said movable portion.

3. The system as recited in claim 1, further comprising a first and a second inlet valve within said respective first and second inlet port, and a first and a second outlet valve within said respective first and second outlet port.

4. The system as recited in claim 3, wherein each of said inlet valves and each of said outlet valves are one-way check valves.

5. The system as recited in claim 1, wherein each of said inlet valves and each of said outlet valves are fluid operated.

6. The system as recited in claim 5, further comprising a controller communicating with each of said inlet valves and each of said outlet valves.

7. The system as recited in claim 1, further comprising a mix head, said first outlet port and said second outlet port communicating with said mix head.

8. The system as recited in claim 1, wherein said drive is mounted to a lower portion on an opposed side of said container relative to said middle portion.

9. The system as recited in claim 1, further comprising a first pump located between a first supply and said first fluid delivery container.

10. The system as recited in claim 1, wherein a first supply for supplying a first fluid material is pressurized.

11. The system as recited in claim 1, wherein each of said outlet ports and each of said inlet ports are substantially J-shaped.

12. The system as recited in claim 1, further comprising a first conduit communicating with each of said supplies and each of said inlet ports, and a second conduit communicating with each of said outlet ports and a mix head assembly, said first conduit and said second conduit including a plurality of bends, each of said plurality of bends less than ninety degrees.

13. The system as recited in claim 1, further comprising a mix head mounted remotely from said first fluid delivery container and said second fluid delivery container.

14. The system as recited in claim 13, further comprising a first conduit in communication with said mix head and said first fluid delivery container, and a second conduit in communication with said mix head and said second fluid delivery container, said first conduit defining a first path and said second conduit defining a second path completely independent of said first inlet port and said second inlet port.

15. A molding machine comprising:

a first fluid delivery container;

a second fluid delivery container;

a first inlet port communicating with said first fluid delivery container to receive a first fluid material into said first fluid delivery container;

a first inlet valve within said first inlet port;

a second inlet port communicating with said second fluid delivery container to receive a second fluid material into said second fluid delivery container;

a second inlet valve within said second inlet port;

a first outlet port communicating with said second fluid delivery container to discharge the first fluid material from said first fluid delivery container;

a first outlet valve within said first outlet port, said first outlet port in communication with said first fluid delivery container independent of said first inlet port;

a second outbound port communicating with said second fluid delivery container to discharge the second fluid material from said second fluid delivery container, said second outlet port in communication with said second fluid delivery container independent of said second inlet port;

a movable portion attached to said first and said second fluid;

a second outlet valve within said second outlet port;

a mix head communicating with said first outlet port and said second outlet port;

a movable portion attached to said first and said second fluid delivery containers; and a drive to drive said movable portion, said moveable portion simultaneously intaking the first fluid material into said first fluid delivery container and the second fluid material into said second fluid delivery container in response to said drive driving said moveable portion in a first direction and to simultaneously discharge the first fluid material from said first fluid delivery container and the second fluid material from said second fluid delivery container in response to said drive driving said moveable portion in an opposite direction.

16. The system as recited in claim 15, wherein said first fluid delivery container has a first capacity and said second fluid delivery container has a second capacity, said first capacity differing from said second capacity.

17. The system as recited in claim 15, further comprising a controller communicating with each of said inlet valves and each of said outlet valves.

18. The system as recited in claim 15, wherein each of said inlet valves and each of said outlet valves are fluid driven valves.

19. The system as recited in claim 15, further comprising a first piston movably mounted within said first fluid delivery container, and a second piston movably mounted within said second fluid delivery container, said first piston and said second piston attached to said moveable portion.

20. The system as recited in claim 15, further comprising a first conduit in communication with said mix head and said first fluid delivery container, and a second conduit in communication with said mix head and said second fluid delivery container, said first conduit defining a first path and said second conduit defining a second path completely independent of said first inlet port and said second inlet port.

21. The system as recited in claim 20, wherein said first conduit and said second conduit including a plurality of bends, each of said plurality of bends less than ninety degrees.

22. A method of communicating a plurality of fluid materials through a molding machine comprising the steps of:

(1) intaking a first material into a first fluid delivery container along a first intake path;

(2) intaking a second material into a second fluid delivery container along a second intake path, said second fluid deliver container sized in relation to said first fluid delivery container to provide a predetermined ratio between the first fluid material and the second fluid material;

(3) discharging the first fluid material from said first fluid delivery container and the second fluid material from said second fluid delivery container to a common mix head to dispense the predetermined ratio between of the first fluid material and the second fluid material at each discharge, the first and second material communicated to the mix path along a respective first and second output path completely independent of the first intake path and the second intake path; and (4) mixing the first and second material within the mix head.

23. A method as recited in claim 22, further comprises the step of pressurizing one of the first materials prior to said step (1).

* * * * *

UNITED STATES PATENT AND TRADEMARK OFFICE

CERTIFICATE OF CORRECTION

PATENT NO. : 6,390,661 B1
DATED : May 21, 2002
INVENTOR(S) : Bellasalma et al.

It is certified that error appears in the above-identified patent and that said Letters Patent is hereby corrected as shown below:

Column 6,
Line 56, delete "is".

Column 7,
Line 6, "fist" should read -- first --.

Signed and Sealed this

Eighth Day of October, 2002

*Attest:*

*Attesting Officer*

JAMES E. ROGAN
*Director of the United States Patent and Trademark Office*